United States Patent [19]

Givens

[11] 4,432,818

[45] Feb. 21, 1984

[54] COMPOSITIONS FOR USE IN HEAT-GENERATING REACTIONS

[75] Inventor: James R. Givens, Tucson, Ariz.

[73] Assignee: Hughes Aircraft Company, El Segundo, Calif.

[21] Appl. No.: 180,269

[22] Filed: Aug. 22, 1980

[51] Int. Cl.[3] ..... C06B 43/00

[52] U.S. Cl. ..... 149/22; 149/108.2; 149/109.6

[58] Field of Search ..... 149/22, 108.2, 109.6

[56] References Cited

U.S. PATENT DOCUMENTS 3,069,300 12/1962 Damon et al. ..... 149/22

*Primary Examiner*—Stephen J. Lechert, Jr.

*Attorney, Agent, or Firm*—David W. Collins; W. J. Bethurum; A. W. Karambelas

[57] ABSTRACT

Compositions capable of exothermic reaction in the condensed state are prepared by pressing a mixture of powders comprising a reactive metal such as titanium, boron carbide and, optionally, carbon (e.g., graphite and/or lampblack) and boron. With moderately fine particle size of boron carbide (about −400 mesh), sustainer compositions are formed. With considerably finer particle size of boron carbide (about −800 mesh), booster compositions are formed. A preferred composition consists essentially of about 67 to 79% titanium, about 13 to 30% boron carbide, up to about 10% carbon and up to about 10% boron.

23 Claims, 1 Drawing Figure

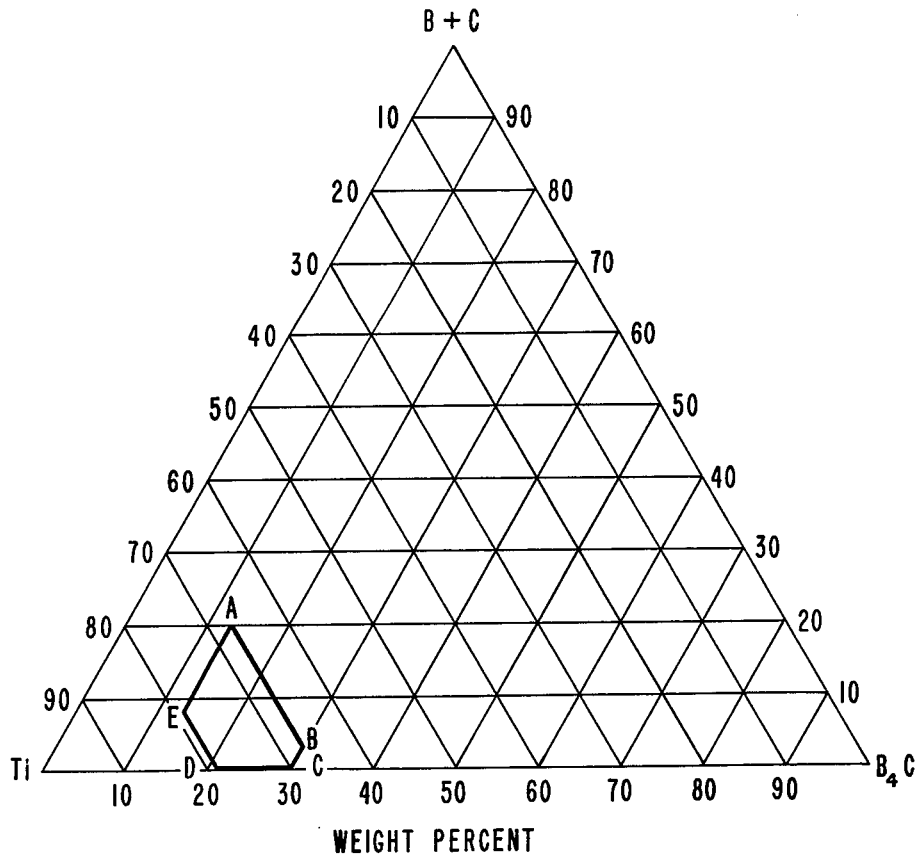
B + C
10
90
20
80
30
70
40
60
50
50
60
40
70
30
80
20
90
10
A
E
B
Ti
D
C
$B_4C$
10
20
30
40
50
60
70
80
90
WEIGHT PERCENT

COMPOSITIONS FOR USE IN HEAT-GENERATING REACTIONS

BACKGROUND OF THE INVENTION

1. Field of the Invention

The invention relates to compositions suitable for use in heat-generating reactions, and, more particularly, to compositions which are capable of undergoing gasless, exothermic reactions in the condensed state to form intermetallic products.

2. Description of the Prior Art

Mixtures of certain elemental metal and metalloid powders are known to be capable of reacting in a self-sustaining manner at high temperatures to form intermetallic products. Such reactions proceed without the formation of a gaseous species, either as a product or intermediate or by boiling or decomposition of a reactant. Examples of condensed state compositions evidencing a gasless, exothermic reaction are given in Vol. 21, *Combustion and Flame,* pp. 77–89, 91–97 (1973). A number of compositions are disclosed, including boron and carbon mixtures with titanium and zirconium.

While these and other intermetallic systems are suitable for such applications as pyrotechnic and ordnance devices, the search continues for specific systems which yield high heat, are inexpensive and are non-pyrophoric, yet subject to convenient initiation.

SUMMARY OF THE INVENTION

In accordance with the invention, compositions are provided which include boron carbide and at least one reactive metal selected from the group consisting of titanium, zirconium, hafnium and vanadium. Such compositions are capable of undergoing gasless, exothermic reactions in the condensed state to form intermetallic products.

The compositions of the invention are inexpensive, generate high heat per unit volume and are non-pyrophoric, yet subject to convenient ignition. The compositions are useful as sustainers or boosters in heat-generating applications. Mixtures which include these compositions are potentially useful in initiation or delay trains for incendiaries, rocket motors and pyrotechnics.

BRIEF DESCRIPTION OF THE DRAWING

The FIGURE is a pseudo-ternary plot of $Ti-B_4C-B+C$ in the Ti-B-C system, depicting the range of compositions in accordance with the invention.

DETAILED DESCRIPTION OF THE INVENTION

The compositions of the invention comprise a mixture of a reactive metal and boron carbide, together with, optionally, carbon and boron. Depending on particle size of the boron carbide, the compositions of the invention may be used as either sustainer or booster compositions in heat-generating applications. A sustainer is a composition formulated without significant compromise toward sensitivity (ease of initiation). A booster is a composition having greater sensitivity, permitting its use as an intermediate step in initiation between a sustainer and a convenient first fire, such as an electrical initiator. Unless otherwise indicated, all amounts given herein are by weight.

Reactive metals useful in the practice of the invention include titanium, zirconium, hafnium and vanadium.

For economic reasons, titanium and zirconium are preferred.

The amount of reactive metal present ranges from a minimum relating to the stoichiometric amount required for the composition to a maximum of stoichiometric plus about 10%. Such increased amounts of the reactive metal over stoichiometric improve mechanical stability of pellets made of the inventive composition. For preferred titanium-containing compositions, titanium ranges from about 67 to 79%.

The amount of boron carbide ($B_4C$) ranges from about 13 to 30%. The stoichiometric composition of titanium and boron carbide is conveniently represented as $$Ti+0.305B_4C \rightarrow 0.61TiB_2+0.39TiC_{0.78}.$$

In weight percent, the stoichiometric composition is 74% Ti, 26% $B_4C$. Accordingly, for Ti-$B_4C$ compositions, titanium may range up to about 77%.

Additional ingredients, such as carbon and boron, may be added to the foregoing mixture in order to improve certain properties. The amount of such additions is given in terms of the final composition.

The composition may include up to about 10% carbon. More specifically, up to about 10% graphite, a crystalline form of carbon, may be included in the composition in order to improve the mechanical properties of pellets made from the composition. Preferably, the composition includes about 1 to 4% graphite as a mechanical binder. The composition may also include about up to about 10% lampblack, an amorphous form of carbon, in partial or total replacement of graphite. Lampblack improves the ease of ignition, but also it provides some deleterious side effects, such as strength degradation and water absorption.

The composition may also include up to about 10% boron. While boron is not generally employed for reasons relating to toxicity and its hygroscopic nature, such amounts as indicated above may be used to promote sensitivity to ignition, since, in its moisture-free state, it improves sensitivity of the composition.

Finally, minor amounts of impurities (less than about 10% of the total composition) may also be present which do not materially affect the desired performance of the composition herein.

The range of compositions of the invention is depicted in the Figure, which is a pseudo-ternary plot of the Ti-B-C system in weight percent. The polygon defined by points A-B-C-D-E-A encompasses the compositions of the invention. For ease of illustration, the composition is plotted in terms of Ti, $B_4C$ and B+C (The total of boron plus carbon). It is contemplated that in preparing compositions of the invention, $B_4C$ is employed, rather than equivalent amounts of boron and carbon, because $B_4C$ has great power density, low water affinity and low cost.

The compositions of the invention are conveniently prepared in powder form. Except as noted below, there appears to be little criticality relating to particle size when employing powders of the ingredients. In general, smaller particle sizes confer improved sensitivity. For example, titanium has been used in mesh sizes ranging from −20 +270 to −270. A mesh size of −270 provides adequate sensitivity for ignitability without the requirement of special handling procedures necessary for smaller sizes such as −300 mesh.

With boron carbide, the preference of smaller size for ease of ignition is complicated by the fact that extremely fine particle size boron carbide renders the final composition a booster composition rather than a sustainer composition. For example, fine particle sizes, such as −325 and −400 mesh, are suitable for sustainer compositions, while ultra-fine particle sizes, such as −800 mesh, are suitable for booster compositions. For reaction speed control, mixtures of both fine and ultra-fine particle size may be employed.

Graphite is conveniently employed in microcrystalline form, often designed as 80% −200 mesh. Lampblack is more easily discussed in terms of surface area and has been employed herein in sizes ranging from about 10 to 8,000 $m^2/g$ with little effect on ease of ignitability.

Boron powder is conveniently used in amorphous form, since it is cheaper than the crystalline form. However, it is less dense and less pure in the amorphous form.

Examples of preferred compositions of the invention include (a) 73.7% Ti (−270 mesh), 24.4% $B_4C$ (−400 mesh) and 1.9% $C_g$, and (b) 71.7% Ti (−270 mesh), 8.9% $B_4C$ (−325 mesh), 8.9% $B_4C$, (−800 mesh) $C_g$ and 8.6% B, where $C_g$ is graphite.

Powders of the specific components are mixed in the desired amount and are dry ball-milled for a period of time. Typically, a period of time of about 5 minutes to 4 hours is generally adequate. However, there seems to be a slight effect in that the longer the mixture is milled, the less sensitive it is to ignitability.

The mixed powder is then pressed or pelletized into the desired shaped slab form, employing conventional techniques. The pelletizing pressure is not critical other than it be adequate so that the slab retains its mechanical integrity and not so high that the slab is difficult to retrieve from the pelletizing die. Adequate pressures range from about 5,000 to 240,000 psi; a pressure of about 40,000 psi appears to generate adequate mechanical stability for many shapes.

There are many uses for compositions of the invention. One example involves placing a slab of the pressed composition against a slab of graphite. Upon igniting the composition of the invention, considerable heat is imparted to the graphite slab, which consequently emits infrared radiation. The IR radiation from the graphite slab may be then detected, as with a suitable infrared detector. Another example is the use as a heat source for thermal batteries or other devices requiring a one-shot heat source. Mixtures which include the compositions of the invention are also contemplated. Such mixtures, which may include even minor amounts of the compositions, are potentially useful in initiation or delay trains for incendiaries, rocket motor and pyrotechnics.

The heat output in terms of calories per unit volume is quite high for the compositions of the invention and is better than mixtures of titanium plus amorphous boron. The compositions of the invention are lower in cost than mixtures of titanium plus crystalline boron.

EXAMPLES

EXAMPLE 1

A composition was prepared by ball milling for 60 minutes a mixture of 71.7% titanium (−270 mesh), 8.9% boron carbide (−325 mesh), 8.9% boron carbide (−800 mesh) 1.9% graphite (−200 mesh) and 8.6% boron (amorphous).

The composition, a sustainer, evidenced the following properties upon ignition: very good radiant intensity, about 2 in/sec reaction speed and excellent sensitivity.

EXAMPLES 2–7

The following compositions listed in Table I below were prepared as in Example 1, employing the powders indicated.

TABLE I

COMPOSITIONS OF THE INVENTION AND PROCESSING THEREOF

| Example | Ti (Mesh Size) | $B_4C$ (Mesh Size) | Graphite (Mesh Size) | Lampblack (Surface (Area, $m^2/g$) | Ball Mill Time, Min |
|---|---|---|---|---|---|
| 2 | 75.9 (−270) | 16.7 (−325) | 3.7 (−200) | 3.7 (300) | 20 |
| 3 | 73.7 (−270) | 24.4 (−325) | 1.9 (−200) | — | 20 |
| 4 | 73.7 (−270) | 24.4 (−400) | 1.9 (−200) | — | 60 |
| 5 | 73.7 (−270) | 24.4 (−500) | 1.9 (−200) | — | 60 |
| 6 | 73.7 (−270) | 24.4 (−600) | 1.9 (−200) | — | 60 |
| 7 | 73.7 (−270) | 24.4 (−800) | 1.9 (−200) | — | 20 |

The following results of ease of ignition, suitability (sustainer or booster) and radiance were obtained for the foregoing compositions, as listed in Table II below.

TABLE II

PROPERTIES OF COMPOSITIONS OF THE INVENTION

| Composition (Example No.) | Ease of Ignition and Suitability | Radiance |
|---|---|---|
| 2 | very good sustainer | good |
| 3 | fair sustainer | excellent |
| 4 | good sustainer | very good |
| 5 | good sustainer | very good |
| 6 | very good sustainer | good |
| 7 | good booster* | poor |

*Ease of ignition compared to other boosters; boosters as a class are much easier to ignite than sustainers.

I claim:

1. A composition capable of gasless exothermic reaction in the condensed state which includes boron carbide plus at least one reactive metal selected from the group consisting of titanium, zirconium, hafnium and vanadium.

2. The composition of claim 1 in which the reactive metal is present in an amount ranging from stoichiometric to stoichiometric plus about 10%.

3. The composition of claim 2 in which the reactive metal consists essentially of titanium.

4. The composition of claim 3 consisting essentially of about 67 to 79% titanium, about 13 to 30% boron carbide, up to about 10% carbon and up to about 10% boron.

5. The composition of claim 4 in which the carbon consists essentially of at least one member selected from the group consisting of crystalline carbon and amorphous carbon.

6. The composition of claim 5 consisting essentially of about 75.9% Ti, about 16.7% $B_4C$, about 3.7% graphite and about 3.7% lampblack.

7. The composition of claim 5 in which the carbon consists essentially of graphite, present in an amount ranging from about 1 to 4%.

8. The composition of claim 7 consisting essentially of about 73.7% Ti, about 24.4% $B_4C$ and about 1.9% graphite.

9. The composition of claim 7 consisting essentially of about 71.7% Ti, about 17.8% $B_4C$, about 1.9% graphite and about 8.6% boron.

10. A mixture which includes the composition of claim 1.

11. An infrared emitter comprising in combination a graphite slab and a heat-generating slab, said heat-generating slab consisting essentially of about 67 to 79% Ti, about 13 to 30% $B_4C$, up to about 10% C and up to about 10% B.

12. The infrared emitter of claim 11 in which the carbon consists essentially of at least one member selected from the group consisting of crystalline carbon and amorphous carbon.

13. The infrared emitter of claim 11 in which the crystalline carbon consists essentially of graphite, present in an amount ranging from about 1 to 4%.

14. A process for preparing a composition capable of exothermic reaction in the condensed state which includes mixing powders of at least one reactive metal selected from the group consisting of titanium, zirconium, hafnium and vanadium with boron carbide powder, the reactive metal present in at least stoichiometric amount.

15. The process of claim 14 in which the reactive metal ranges in amount from stoichiometric to stoichiometric plus about 10%.

16. The process of claim 15 in which the reactive metal consists essentially of titanium.

17. The process of claim 16 in which the composition consists essentially of about 67 to 79% titanium, about 13 to 30% boron carbide, up to about 10% carbon and up to about 10% boron.

18. The process of claim 17 in which the carbon consists essentially of at least one member selected from the group consisting of crystalline carbon and amorphous carbon.

19. The process of claim 18 in which the composition consists essentially of about 75.9% Ti, about 16.7% $B_4C$, about 3.7% graphite and about 3.7% lampblack.

20. The process of claim 18 in which the crystalline carbon consists essentially of about graphite, present in an amount ranging from about 1 to 4%.

21. The process of claim 20 in which the composition consists essentially of about 73.7% Ti, about 24.4% $B_4C$ and about 1.9% graphite.

22. The process of claim 20 in which the composition consists essentially of about 71.7% Ti, about 17.8% $B_4C$, about 1.9% graphite and about 8.6% boron.

23. The process of claim 17 in which a fine mesh size of boron carbide is employed.

* * * * *

Disclaimer 4,432,818.—*James R. Givens,* Tucson, Ariz. COMPOSITIONS FOR USE IN HEAT-GENERATING REACTIONS. Patent dated Feb. 21, 1984. Disclaimer filed Nov. 19, 1984, by the assignee, *Hughes Aircraft Co.*

Hereby enters this disclaimer to claims 1–23 of said patent.

[*Official Gazette September 24, 1985.*]